United States Patent [19]

Funk

[11] 4,108,385

[45] Aug. 22, 1978

[54] COLLOIDAL MILL

[76] Inventor: Friedrich Funk, Refugium, 4713 Matzendorf, Switzerland

[21] Appl. No.: 701,030

[22] Filed: Jun. 29, 1976

[30] Foreign Application Priority Data

Jul. 9, 1975 [CH] Switzerland ..... 8941/75
Apr. 27, 1976 [CH] Switzerland ..... 5263/76

[51] Int. Cl.[2] ..... B02C 23/36

[52] U.S. Cl. ..... 241/46.04; 241/46.17; 241/172

[58] Field of Search ..... 241/46.04, 46.08, 46.11, 241/46.15, 46.17, 171, 172, 175, 182, 192, 195; 259/9, 10, 109, 110

[56] References Cited

U.S. PATENT DOCUMENTS

| | | | |
|---|---|---|---|
| 1,355,137 | 10/1920 | Frick | 259/109 |
| 1,796,411 | 3/1931 | Shaut | 259/109 |
| 2,186,164 | 1/1940 | Brown | 241/182 |
| 2,639,747 | 5/1953 | Burn et al. | 241/192 |
| 2,748,666 | 6/1956 | Forrest | 241/46.17 |
| 2,943,800 | 7/1960 | Wultsch | 241/46.04 |
| 3,027,102 | 3/1962 | Lodige et al. | 241/46.17 |
| 3,037,712 | 6/1962 | Hosokawa et al. | 241/192 |
| 3,090,606 | 5/1963 | Burnet | 259/9 |
| 3,259,374 | 7/1966 | Doebl et al. | 259/10 |
| 3,814,334 | 6/1974 | Funk | 241/73 |

*Primary Examiner*—Granville Y. Custer, Jr.
*Attorney, Agent, or Firm*—Imirie, Smiley & Guay

[57] ABSTRACT

An agitator or stirrer mill and especially a colloidal mill, having rotating grinding impellers in a vessel, the blades of such impellers being adjustable in their inclination relatively to a radial plane of the vessel and rotating axle respectively in order to adjust the stirring and agitating intensity. This may allow treatment of agents without the use of auxiliary milling particles such as balls in the mill. Further, the blades of the impellers are individually removable and readily exchangeable in order to replace worn impeller blades.

5 Claims, 4 Drawing Figures

COLLOIDAL MILL

The present invention relates to a stirrer mill and more especially a colloidal mill having grinding impellers rotating in a vessel, the vanes of which have an axial conveying action and are for rotating grinding bodies with a material to be treated.

A known stirrer mill, German Auslegungschrift 1296950 has integrally formed grinding impellers which are coaxially arranged. In this mill it is impossible to adapt the action of the individual impellers or the overall effect of the impellers optimally. Moreover, it has been found that the grinding wheels or impellers of stirrer mills are subjected to considerable wear especially at the outer, rapid rotating points. The stirrer impellers are of integral design in known manner, and consequently as soon as wear exceeds a permissible extent the mill has to be dismantled and whole impellers together with their bosses have to be replaced.

It is an object of the invention to provide impellers in such a manner that they are readily adjusted to achieve optimum effect and that worn components can be readily replaced.

According to the present invention there is provided an agitator or stirrer mill and especially colloidal mill, having grinding impellers rotating in a vessel, the blades of which have an axial conveying action and to act to rotate grinding bodies together with a material to be treated, characterised by the feature that at least one grinding impeller has blades which are adjustable in inclination and are replaceable. The construction according to the invention permits each individual impeller vane of the whole mill to be optimally adjusted in order to obtain the best grinding action for a specific material to be treated. Also extensively worn impeller blades maybe individually replaced.

It has been found that axially conveying impellers, especially such impellers having blades adjustable in inclination to the axis of the mill, are subjected to very extensive wear.

It is also an object of the present invention to provide stirring impellers so that relatively simple and cheap components or parts are subjected to wear and that these parts are also readily replaceable, whilst at the same time it is an economical possibility to produce these simple parts of a particularly abrasion-resistant material such as, for example, ceramics. At the same time it is also possible for the parts subjected to a particularly high degree of wear to be made of a material compatible with the material to be treated thus, for example, when treating foodstuffs and semi-luxuries so as to avoid any flavour changes.

This object is attained in that flat blades are secured in a holder which is pivotally and fixably retained in the boss. It has been found that such a holder, which may be made of steel and having a relatively low peripheral speed, is subjected substantially to no wear or to a minimum of wear. Only the external parts of the blades which have substantially higher peripheral speeds, are subject to considerable wear unless special materials for avoiding excessive wear are used.

The invention will be described further, by way of example, with reference to the accompanying drawings, in which.

Figure 1:
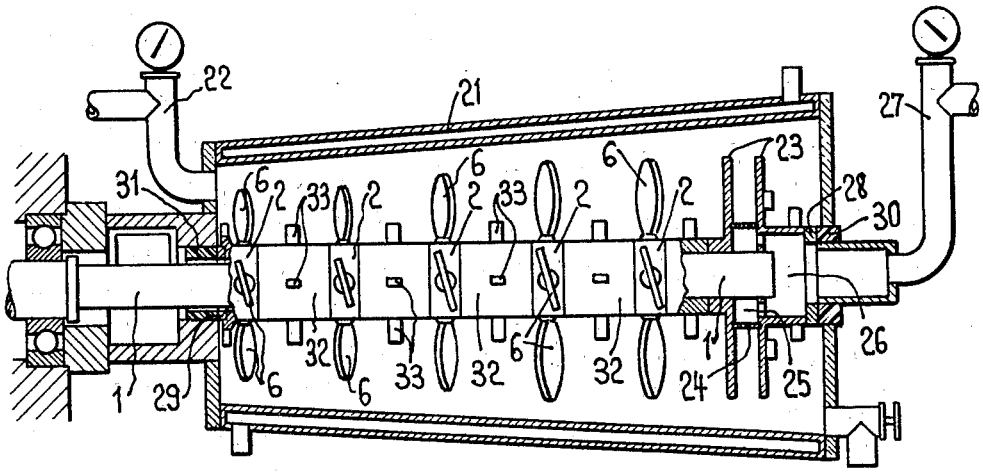
FIG. 1 is a schematic section through a stirrer mill.

A stirrer mill is shown schematically in FIG. 1 and has a vessel 21 in which a shaft 1 is located and mounted at one end. Material to be treated is introduced into the vessel 21 through a conduit 22. The shaft 1 has a sieve 24 mounted thereon between two discs 23 and through which sieve the treated material is discharged via the spaces 25 and 26 to a return flow conduit 27. Grinding bodies, e.g. small glass balls possibly contained in the vessels, are retained in the vessel by the sieve 24. Slip rings 28 and 29 are rotatable with the shaft and abut against soft sealing sleeves 30 and 31 respectively by means of which the vessel chamber is sealed around the shaft 1.

Grinding impellers each formed of an impeller blade 6 and boss 2 are indicated schematically and shown with the bosses 2 mounted on shaft 1. Examples of the impellers are shown in the remaining figures. Between bosses 2 of adjacent grinding impellers, spacing sleeves 32 are located which have outwardly projecting blades or engaging members 33 — the purpose of which will be explained later.

Figure 2:
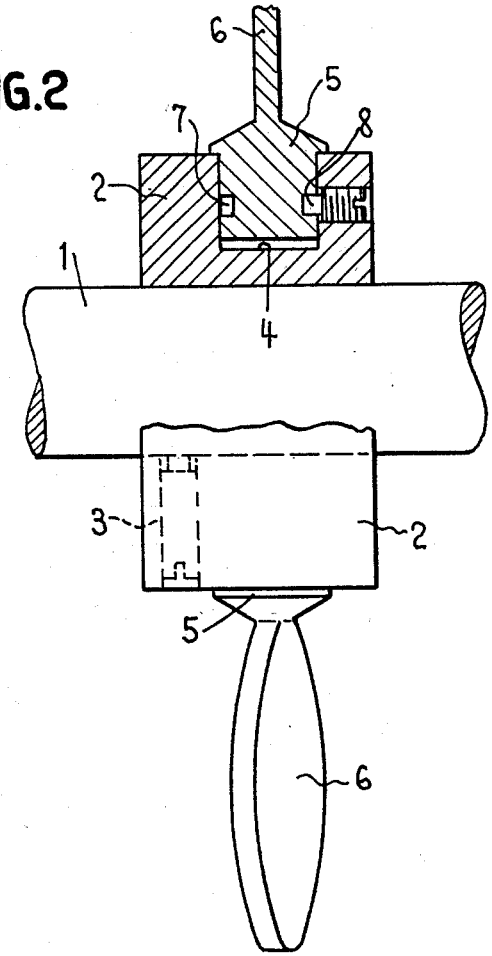
FIG. 2 is a partial fragmentary section of an impeller of the mill of FIG. 1.

In the embodiment of the stirrer impeller shown in FIG. 2, a boss 2 is mounted on the shaft 1 and is secured by means of a screw 3. The boss 2 is provided with a number of peripheral cylindrical bores 4, for example, two diametrically opposite or any number of bores spaced peripherally apart. In each of these bores a cylindrical pin 5 of an impeller blade 6 is inserted. The pin 5 has an annular groove 7 in which the inner end of a securing screw 8 engages at one point. The screw secures the impeller blade 6 against radial displacement and rotation. When the screw 8 is slackened, the impeller blades 6 may be adjusted so as to assume the required inclined position or, alternatively, the impeller blades which are particularly subjected to wear, may readily be replaced. The blades 6 and the boss 2 are preferably made of a wear or abrasion-resistant plastics material or coated with such material.

Upon rotation of the shaft 1, the grinding bodies and the material to be treated are carried along by the impeller blades 6 not only by friction and being thrown outwardly due to centrifugal force, but are also axially conveyed due to the axial conveying action of the grinding impellers. Hence, a substantially more intensive turbulence is obtained of the grinding bodies and the material to be treated and, hence, a substantially more intensive grindng action is also obtained than when conventional flat, radially extending grinding discs are provided. The grinding impellers preferably have an alternately opposing axial conveying action. In this case, a particularly intensive movement may be obtained for the grindng bodies and the material to be treated and hence an especially intensive grindng action. It is, however, also possible for the individual impeller blades 6 of each grinding disc to be alternately inclined oppositely and hence cause an alternately axial conveying action in the opposite direction, whereby a very intensive turbulence of the grinding bodies and the material to be treated can also be obtained.

Grinding impellers of identical or different kind having different dimensions may be arranged, particularly when the vessel of the mill is frustro-conical in shape.

The blades of the grinding impellers may in the simplest case be flat. But they may also have an uneven, hydrodynamic or an uneven shape particularly favourable for the grinding action.

Figure 3:
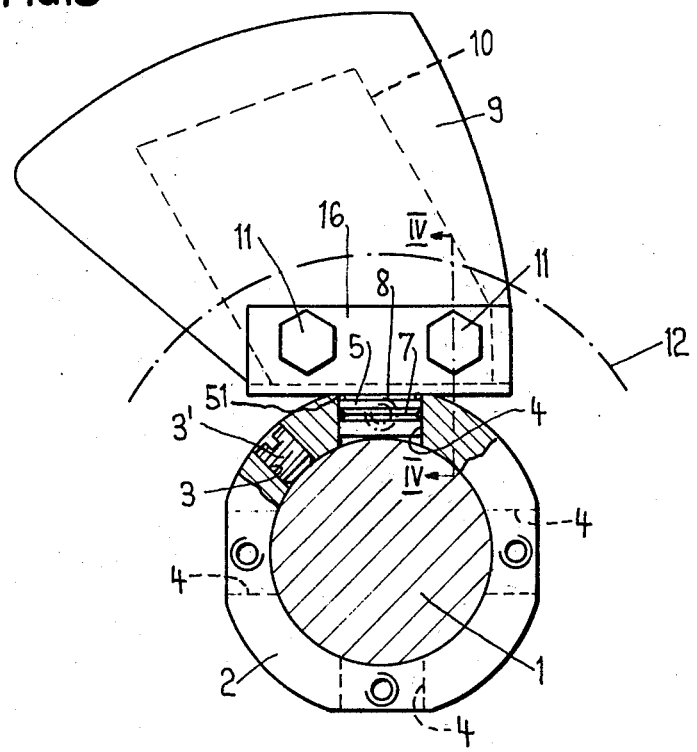
FIG. 3 is a side elevation of a second embodiment of an impeller having an impeller blade with the boss thereof shown partly in section.
Figure 4:
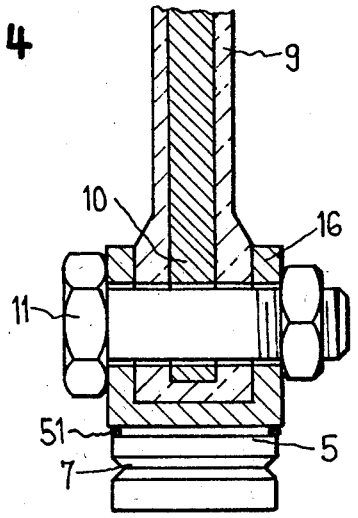
FIG. 4 is a section on an enlarged scale taken on the line IV — IV of FIG. 3.

In the embodiment according to FIGS. 3 and 4, a boss 2 is secured to the shaft 1 of the stirrer mill by means of, for example, a screw 3' inserted in the tapped hole 3. The boss 2 has four bores 4 in each of which a pin 5 of a holder may be inserted. A U-shaped profile 16 is welded to the pin 5 and the components 5 and 16 form a holder. The pin 5 has an annular groove 7 in which a securing screw 8 engages and secures the holder against rotation and axial displacement. The screw 8 is mounted in a tapped bore located normal to the bore 4. An O-ring 51 prevents the entry of solid particles into the bore 4.

The inner edge of the grinding blade 9 extends into the U-shaped profile. The blade 8 may, for example, be made of ceramics but may have any suitable material coating on the outside such as plastics material etc. A reinforcement 10 may be formed in the blade 9. Both of the outwardly projecting shanks of the U-shaped profile and the blade 9 with its reinforcement 10 have holes through which securing screws 11 project and secure the blade to the holder. As already stated, it has been found that considerable wear only occurs in a region outside the holder, for example, in the region of FIG. 3 outside the chain-dotted line 12. The holder, a relatively complex and costly component, is thus subjected to a minimum of wear and therefore has a long life span. Also the holder may be made of a material favourable for its production and its function since it is subjected to substantially no abrasion and the abrased particles cannot have any significant unfavourable effect on the material to be treated. Moreover, the blades 9 which are subjected to considerable wear are formed as very simple, flat parts which may readily be replaced without incurring high costs. At the same time, the simple shape of the blades permits their production from a vast range of optional materials, especially hard materials and/or such which are compatible with the material to be treated. Ceramics materials, sintered materials and the like may be used which are very hard and abrasion-resistant and the abrasion of which even when treating foodstuffs and semi-luxury materials e.g. chocolate, does not interfere. These favourable effects, however, do not come fully into effect even when the vessel of the mill is made of a corresponding material thus, e.g. of ceramics, or is lined therewith, since the vessel is also subjected to considerable abrasion.

A decisive contribution to the reduction of the abrasion wear and at the same time to avoid admixture of finely ground foreign bodies to the material to be treated in a stirrer mill with axially conveying blades, is also possible in that the operation is possible without grinding bodies. It has been found that with intensive grinding action with blades having an axial conveyor action even without grinding bodies in the treatment vessel, such a high grinding effect can be obtained that the treatment occurs within adequate time.

The blades may have a flat, simple shape although, if desired may be made uneven to obtain definite hydrodynamic effects.

To reduce the wear of the holders for the blades even more, it is particularly favourable in accordance with the embodiment of FIG. 1 to provide between the stirring discs provided with blades spacing sleeves with engaging members 33 or flat, radially extending flanges which have an additional stirring and engaging effect for the grinding bodies. The surprising discovery was made that these measures are capable of substantially reducing the wear of the holders and especially their screws.

What I claim is:

1. A colloidal mill comprising:

a horizontally disposed vessel having a rotatably mounted shaft extending therethrough, an inlet conduit at one end of said vessel allowing continuous flow into the vessel of material to be treated, an outlet sieve at the other end of said vessel allowing disintegrated material to leave the vessel, an outlet conduit at the other end of said vessel for draining the treated material, a plurality of grinding impellers mounted on said shaft for rotation in said vessel, each impeller comprising a blade which has an axial conveying action and the impellers acting to agitate and rotate said material to be treated, each grinding impeller blade being adjustable in inclination and easily replaceable, at least the outer surfaces of said impeller blades and the inner surface of said vessel in contact with the material being of ceramic material; at least two intermediate grinding impellers have an axial conveying action in opposite directions, said grinding impellers each comprising a boss rigidly mounted to said shaft, flat blades each removably secured in a holder has a U-shaped profile which receives an edge of the blade and a pin engaging in a bore of the boss.

2. A mill as claimed in claim 1, in which the blade secured to the U-shaped profile by threaded members.

3. A mill as claimed in claim 1 in which elements having radially projecting portions are provided on the shaft between the impeller members.

4. An agitating or stirrer mill and especially colloidal mill comprising a horizontal vessel, an inlet conduit at one end of said vessel allowing continuous flow of material to be treated into the vessel, an outlet sieve at the other end of said vessel allowing disintegrated material to leave the vessel and an outlet conduit for discharging the treated material leaving said vessel through said sieve, a shaft rotatably mounted in said vessel, grinding impellers, mounted spaced apart on said shaft and comprising blades which have an axial conveying action and act to agitate and rotate grinding bodies together with said material to be treated in said vessel, at least one grinding impeller having blades which are adjustable in inclination and are easily replaceable, and at least one element having radially projecting portions mounted on said shaft in the space between two said grinding impellers.

5. An agitator or stirrer mill and especially a colloidal mill, comprising a vessel, a shaft mounted in said vessel for rotation on a horizontal axis, grinding impellers adjustably mounted on said shaft for rotation in said vessel, said impellers comprising blades which have an axial conveying action and act to rotate and agitate grinding bodies together with the material to be treated in said vessel, at least one grinding impeller having holder means, a flat blade secured in said holder means, and means adjustably mounting said holder means on said shaft whereby the inclination of said blade easily can be adjusted by rotatable adjustment of said holder means and worn blades easily can be removed from said holder means and replaced by new blades, and a plurality of elements having radially projecting portions fixedly mounted on said shaft between said grinding impellers.

* * * * *